US005732145A

United States Patent [19]

Tsao

[11] Patent Number: 5,732,145

[45] Date of Patent: Mar. 24, 1998

[54] SPEAKER SYSTEM AND DEVICE RACK ARRANGEMENT

[76] Inventor: Ye-Ming Tsao, 6-4 Fl., No. 188, Ting-Chou Rd., Taipei, Taiwan

[21] Appl. No.: 820,681

[22] Filed: Mar. 18, 1997

[51] Int. Cl.[6] ..... H04R 25/00

[52] U.S. Cl. ..... 381/188; 381/205; 181/199

[58] Field of Search ..... 381/24, 86, 87, 381/88, 89, 90, 188, 205, 158; 181/199, 207, 208; 248/638, 639, 676

[56] References Cited

U.S. PATENT DOCUMENTS 3,183,305 5/1965 Jespersen ..... 381/188

*Primary Examiner*—Huyen D. Le

*Attorney, Agent, or Firm*—Bacon & Thomas

[57] ABSTRACT

A speaker system and device rack arrangement including a plurality of cabinets equipped with speakers, a flat top plate mounted on the cabinets at the top, a plurality of sound absorbing cushions respectively sandwiched in between the cabinets and the flat top plate, and a carrier plate supported on the flat top plate for carrying tuner, amplifier, etc., the carrier plate having a plurality of springy cones at the bottom respectively supported on the flat top plate above each cabinet.

7 Claims, 3 Drawing Sheets

SPEAKER SYSTEM AND DEVICE RACK ARRANGEMENT

BACKGROUND OF THE INVENTION

The present invention relates to audio equipment racks, and more particularly to such an audio equipment rack which utilizes speaker systems as stands for supporting a flat top plate and a carrier plate for carrying tuner, amplifier, etc.

In a regular audio system, the speaker systems and the tuner are separately disposed. When the speaker systems are driven to produce sound, the cabinets of the speaker systems may be forced to vibrate. The vibration must be properly controlled so as not to interfere with the quality of the sound. There is known a resonance eliminating stand for supporting the cabinet of a speaker system. This structure of resonance eliminating stand comprises a stand body, a stand base, a conical member, and a disk. The conical member is a tapered rod having a flat bottom end. The disk has a certain thickness, a bottom side curved inwards, and a circular center through hole adapted for receiving the tapered tip of the conical member. The stand base and the stand body have a respective circular center hole facing each other and adapted for receiving the disk in between the stand base and the stand body. There is also known a shock absorbing cabinet stand for supporting the cabinet of a speaker system. This structure of shock absorbing cabinet stand comprises a top cushion, a bottom cushion, and a support fastened between the top cushion and the bottom cushion. The support has two opposite ends respectively tapered.

The aforesaid devices are designed to reduce the resonant energy transmission area of the cabinet. However, because the cabinets of regular speaker systems are made from wooden material, gaps exist among wooden parts. This loose structure design tends to cause a vibration.

SUMMARY OF THE INVENTION

It is the main object of the present invention to provide a speaker system and device rack arrangement which uses speaker systems as stands of a rack for supporting audio equipment, permitting the cabinets of the speaker systems to be firmly held down by the load to eliminates the occurrence of vibration. It is another object of the present invention to provide a speaker system and device rack arrangement which combines an audio equipment rack and speaker systems into a rack assembly for supporting tuner, amplifier, or any other devices, so as less audio equipment installation space is needed. It is still another object of the present invention to provide a speaker system and device rack arrangement which keeps the speaker systems connected together for supporting the tuner and other parts of an audio equipment.

DETAILED DESCRIPTION OF THE PREFERRED EMBODIMENT

Figure 1:
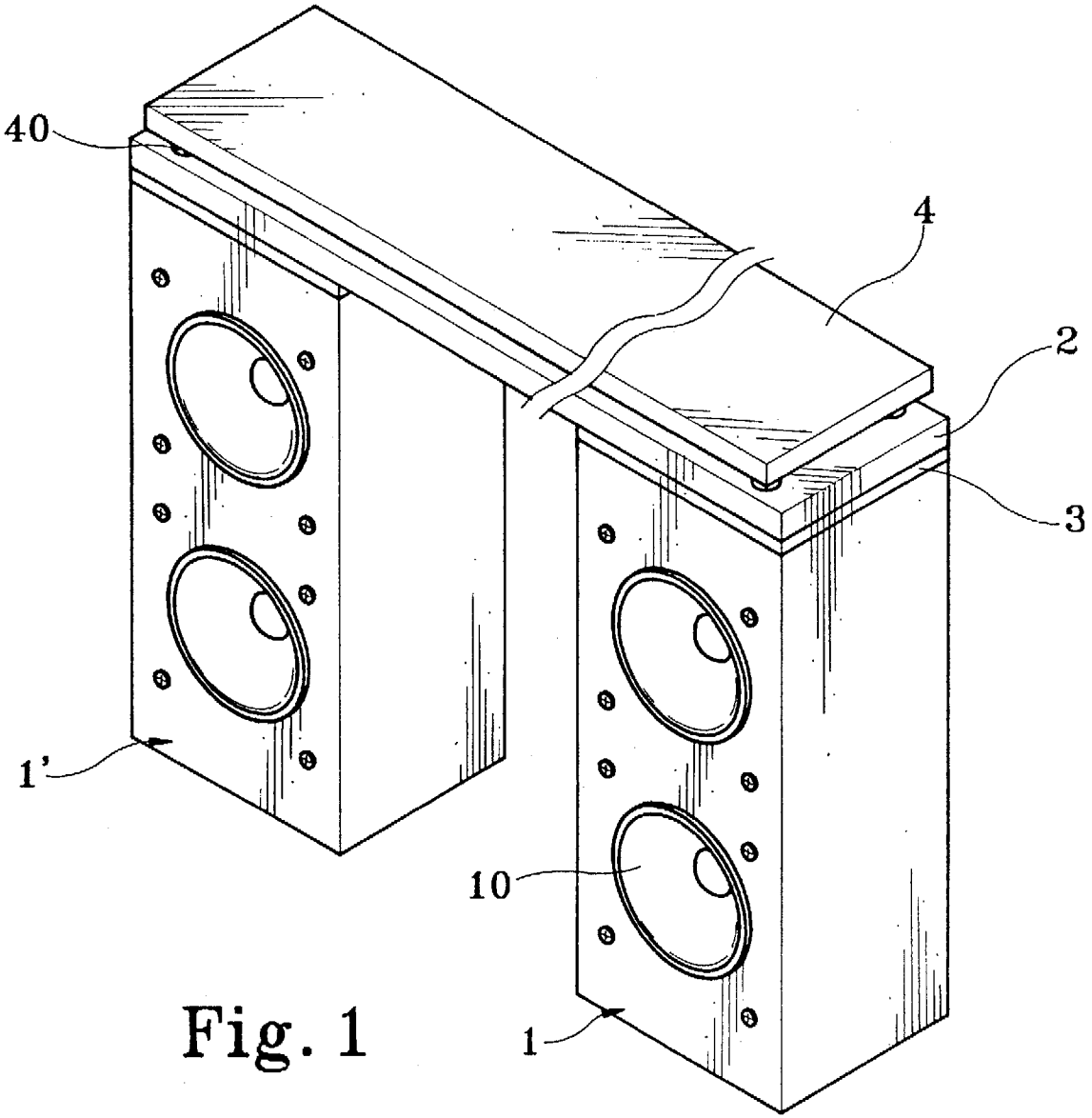
FIG. 1 is an elevational view of the present invention.
Figure 2:
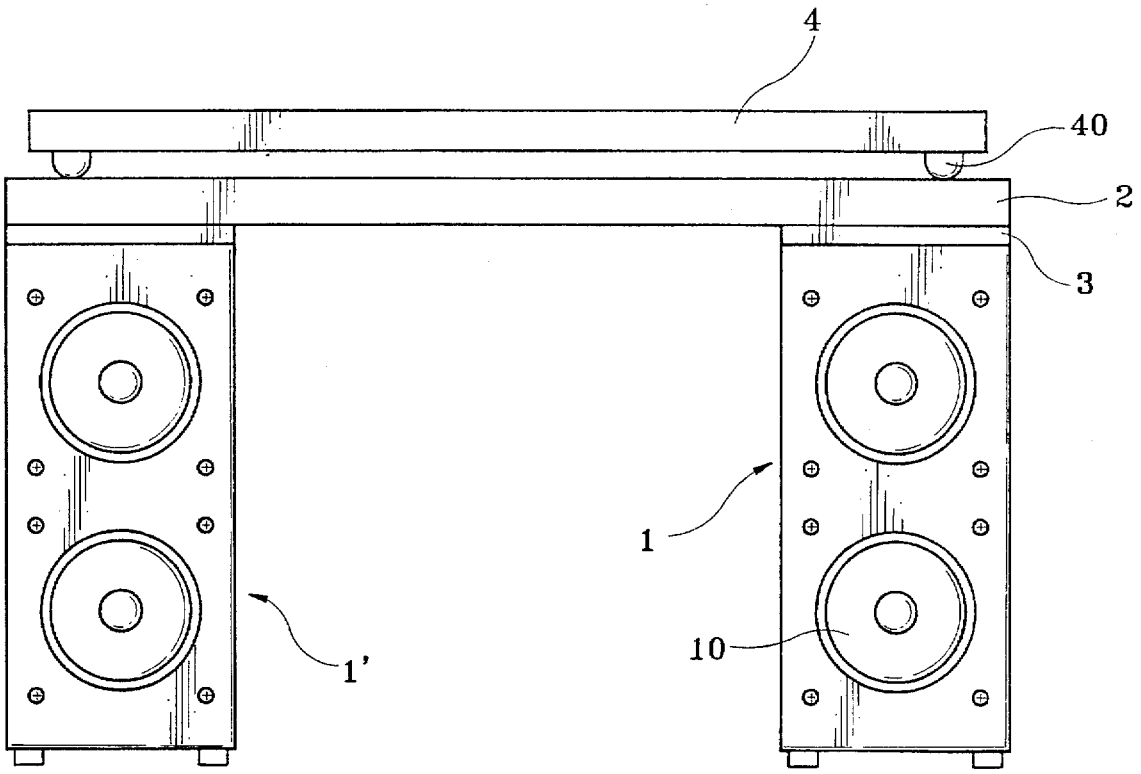
FIG. 2 is a front view of the present invention.
Figure 3:
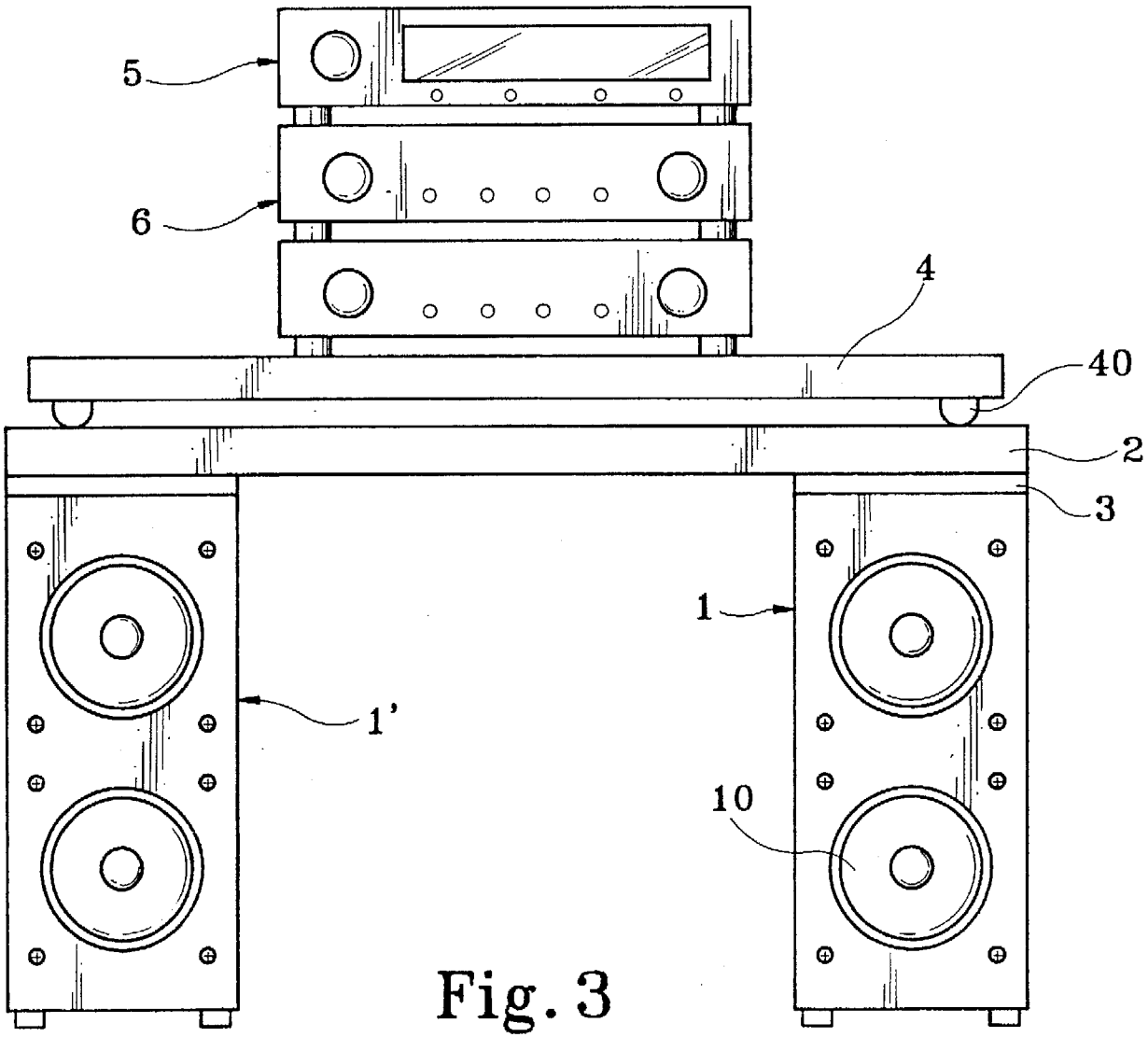
FIG. 3 is an applied view of the present invention, showing a tuner and an amplifier carried on the carrier plate.

Referring to FIGS. 1, 2 and 3, a plurality of cabinets 1;1' with speakers 10 are arranged in parallel, and fastened together by a flat top plate 2. The flat top plate 2 is mounted on the cabinets 1 at the top and fixedly secured thereto by for example screws. Porous sound absorbing cushions 3 are respectively sandwiched in between the cabinets 1;1' and the flat top plate 2. The sound absorbing cushions 3 are made from soft material for example rubber or sponge, and adapted to prevent transmission of vibrations between the cabinets 1;1'. A carrier plate 4 is supported on the flat top plate 2 for carrying tuner 5, amplifier 6, etc. (see FIG. 3). The carrier plate 4 is made from rigid material that does not deform easily when carrying a load. A plurality of springy cones 40 are fixedly mounted on the carrier plate 4 at the bottom side, and respectively supported on the flat top plate 2 above each cabinet 1;1'. The springy cones 40 are preferably made from rubber. The cross section of the springy cones 40 reduces gradually from the carrier plate 4 toward the flat top plate 2, so that less vibration transmission area exists between the flat top plate 2 and the carrier plate 4. Because the springy cones 40 are respectively supported on the flat top plate 2 above each cabinet 1;1', the weight of the load carried on the carrier plate 4 is directly received by the cabinets 1;1'.

According to the aforesaid arrangement, the cabinets 1;1' are simultaneously used as rack stands to support the flat top plate 2, the carrier plate 4 and the load carried on the carrier plate 4. Because the cabinets 1;1' bear a heavy burden, they are firmly retained in place against vibrations, and interference of resonance is eliminated.

I claim:

1. A speaker system and device rack arrangement comprising:

a plurality of cabinets equipped with speakers;

a flat top plate mounted on said cabinets at the top;

a plurality of sound absorbing cushions respectively sandwiched in between said cabinets and said flat top plate; and a carrier plate supported on said flat top plate for carrying devices, said carrier plate having a plurality of springy cones at a bottom side thereof respectively supported on said flat top plate above each cabinet.

2. The speaker system and device rack arrangement of claim 1 wherein said flat top plate is detachably mounted on said cabinets.

3. The speaker system and device rack arrangement of claim 1 wherein said flat top plate is fixedly secured to said cabinets by screws.

4. The speaker system and device rack arrangement of claim 1 wherein said sound absorbing cushions are made from sponge.

5. The speaker system and device rack arrangement of claim 4 wherein said sound absorbing cushions are made from foamed rubber.

6. The speaker system and device rack arrangement of claim 1 wherein the cross section of said springy cones of said carrier plate reduces gradually from said carrier plate toward said flat top plate.

7. The speaker system and device rack arrangement of claim 1 wherein said springy cones of said carrier plate are made from rubber.

* * * * *